US008986139B1

(12) United States Patent
Gideon

(10) Patent No.: US 8,986,139 B1
(45) Date of Patent: Mar. 24, 2015

(54) ATHLETIC TRAINING APPARATUS

(76) Inventor: Steve Gideon, Leander, TX (US)

( * ) Notice: Subject to any disclaimer, the term of this patent is extended or adjusted under 35 U.S.C. 154(b) by 141 days.

(21) Appl. No.: 13/565,238

(22) Filed: Aug. 2, 2012

Related U.S. Application Data

(60) Provisional application No. 61/609,203, filed on Mar. 9, 2012.

(51) Int. Cl.
*A63B 69/00* (2006.01)
*A63B 69/36* (2006.01)

(52) U.S. Cl.
CPC ..... *A63B 69/002* (2013.01); *A63B 69/0071* (2013.01); *A63B 69/0059* (2013.01); *A63B 69/3608* (2013.01); *A63B 2243/0025* (2013.01)
USPC ..... 473/438; 473/422; 473/450; 473/458

(58) Field of Classification Search
CPC ..... A63B 2243/0025; A63B 2243/0037; A63B 2243/007; A63B 69/002; A63B 69/345; A63B 69/00; A63B 69/0071; A63B 69/0059; A63B 69/3608; A63B 2069/0008; A63B 2069/0006
USPC ..... 473/422, 450, 458, 464, 438, 615, 212, 473/215; 482/105, 106
See application file for complete search history.

(56) References Cited

U.S. PATENT DOCUMENTS 1,591,523 A * 7/1926 Fuller ..... 473/215
2,773,691 A * 12/1956 Redfield ..... 473/212
2,980,426 A 4/1961 Johnson
3,101,196 A * 8/1963 Ferrara ..... 473/63
3,820,783 A 6/1974 Caveness
4,383,685 A 5/1983 Bishop
4,984,789 A * 1/1991 Socci ..... 473/458
5,222,733 A * 6/1993 Brunty ..... 473/438
5,257,779 A * 11/1993 Dalbo ..... 473/215

(Continued)

FOREIGN PATENT DOCUMENTS

GB 1601080 A * 10/1981 ..... A63B 63/00
WO WO 0059586 A1 * 10/2000 ..... A63B 63/00

OTHER PUBLICATIONS

Smart Football—Analysis and Strategy by Chris, "Can a quarterback's throwing motion be improved?" Aug. 22, 2011, http://smartfootball.com/quarterbacking/can-a-quarterbacks-throwing-motion-be-improved, 10 pages. [Retrieved Aug. 2, 2012].

(Continued)

*Primary Examiner* — Mitra Aryanpour
(74) *Attorney, Agent, or Firm* — Meyertons, Hood, Kivlin, Kowert & Goetzel, P.C.

(57) ABSTRACT

Apparatuses that facilitate training for proper, repeatable throwing technique in various sports. Embodiments may provide useful feedback to a user when that user deviates from proper techniques for throwing a football, baseball, or similar item. When proper technique is used, the user may experience no interference between the training apparatus and the ball or the user's throwing hand or arm. In contrast, the user's hand, arm, or a held ball may contact portions of the training apparatus in cases where the mechanics of the user's throwing motion deviate from the proper form, thereby providing immediate feedback. In certain embodiments, the training apparatus includes a body section and attachment portions. The attachment portions may receive an upper guide structure extending from a shoulder portion of the body section and a lower guide structure extending from a hip portion of the body section.

20 Claims, 9 Drawing Sheets

(56) References Cited

U.S. PATENT DOCUMENTS

| | | | | |
|---|---|---|---|---|
| 5,320,342 | A | 6/1994 | Houck | |
| 5,375,836 | A * | 12/1994 | Kiser | 473/458 |
| 5,390,929 | A * | 2/1995 | Todaro | 473/215 |
| 6,102,809 | A * | 8/2000 | Nichols | 473/227 |
| 6,645,093 | B2 * | 11/2003 | Sheppard | 473/450 |
| 6,932,724 | B2 * | 8/2005 | Socci | 473/458 |
| 7,074,139 | B2 * | 7/2006 | Vogel | 473/409 |
| 7,686,699 | B2 * | 3/2010 | Snyders | 473/216 |
| 7,722,472 | B2 * | 5/2010 | Cameron et al. | 473/450 |
| 8,740,730 | B1 * | 6/2014 | Przyborowski | 473/438 |
| 2003/0232669 | A1 | 12/2003 | Smith et al. | |
| 2010/0048332 | A1 * | 2/2010 | Torres | 473/458 |

OTHER PUBLICATIONS

ESPN, "The pursuit of throwing perfectly," The 12 things David Fleming learned about being a quarterback, Apr. 21, 2010, http://sports.espn.go.com/espn/page2/story?page=fleming/100421, 4 pages. [Retrieved Aug. 2, 2012].

* cited by examiner

ATHLETIC TRAINING APPARATUS

CROSS-REFERENCE TO RELATED APPLICATION

This application claims benefit of priority to U.S. Provisional Patent Application No. 61/609,203, filed Mar. 9, 2012, which is incorporated by reference herein in its entirety.

BACKGROUND

1. Technical Field

This disclosure relates generally to athletic training devices, and more specifically to apparatuses that may be suited for use in promoting development of proper throwing techniques for participants in various sports (e.g., football, baseball, etc.).

2. Description of Related Art

In various athletic endeavors, the ability of a participant to rapidly and accurately complete a throwing motion is at a premium. For example, during a pass play in the sport of American football, a quarterback must be able to quickly assess the formation of the defensive players, evade a pass rush, and successfully pass the football to a teammate (who may be closely guarded by a defender). Both accuracy and quickness of delivery are directly tied to the quarterback's throwing mechanics, and may be improved by ensuring that proper technique is practiced when throwing the football.

Exemplary representations of a proper technique for throwing a football are shown with reference to FIGS. 1A-D. These figures are adapted from an article written by Dub Maddox, coach at Jenks High School in Oklahoma. See smartfootball.com/quarterbacking/can-a-quarterbacks-throwing-motion-be-improved (posted on Aug. 22, 2011) (hereafter, Maddox Article). The Maddox Article states that "[t]hrowing the football well is not about doing one or two big things great"; instead, "it's about perfecting a thousand different parts of an intricate, complicated kinetic chain that starts in the toes and ends at the finger tips." See Maddox Article (quoting David Fleming, "The Pursuit of Throwing Perfectly," Apr. 21, 2010, available at sports.espn.go.com/espn/page2/story?page=fleming/100421). FIGS. 1A-D are adapted from this article and depict four arm positions within this "kinetic chain." FIG. 1E is an additional figure that depicts the final follow-through position of throwing hand at the end of this "kinetic chain."

Turning now to FIG. 1A, a representation of quarterback 10 is shown holding a football in a position that can be referred to as the "pre-pass triangle," as indicated by reference numeral 12. The Maddox Article explains that this position "provides for a powerful position to launch the football":

> The kinetic chain in the arm starts in the Pre Pass Triangle position. With the elbows level at the base and a loaded wrist in the "cocked" position off the back shoulder, the triangle shape provides for a powerful position to launch the football. If the body was going to throw a punch it would load the arm instinctually in the same position. The Pre Pass Triangle position reduces tendency to internally rotate (wind up) on the throw, aligns arm in a power position, and reduces wasted motion for [ ] a faster release.

This position may be referred to using different nomenclature. For example, some quarterback coaches may call this position the "ready position," the "pyramid position," the "throwing pocket," or the "loaded position." In this position, the quarterback grips the ball with both hands with elbows relaxed by the rib cage. This is a secure ball carriage position for a quarterback getting ready to throw the ball, whether the quarterback is dropping back, sprinting out, bootlegging, etc.

Turning now to FIG. 1B, a representation of quarterback 10 in the "L position" is shown. To get to this position, the quarterback breaks the two-handed grip of football from the pre-pass triangle position 12 by taking the football in the throwing hand, and bringing the football to a position 22 that is above the quarterback's throwing shoulder. A common coaching term for the action needed to get to this position is "up and out," meaning that the quarterback should bring the football up to a nearly fully extended arm position and away from the passer's head to this cocked position in which the arm forms an "L". At this point, the forward throwing motion can begin. The Maddox Article elaborates on the manner in which the quarterback's rotator cuff muscles contribute to raising the arm to the L position:

> The move to this position is done by using the 4 rotator cuff muscles that surround the scapula. The infrasprinatus and teres minor externally rotate the arm back into the "L" position. When the arm is in the "L" position it elongates the suprasprinatus and subscapularis which allow the muscles to accelerate the elbow to the lead position.

Turning now to FIG. 1C, a representation of quarterback 10 with his arm in position 32 is shown. This position is also depicted by an angle marking of 45 degrees found in the Figure, which describes the desired position of the upper arm at this stage in the throwing motion. The Maddox Article describes this position as follows:

> [This is t]he lead position the elbow has to be in to support the wrist. You may have heard coaches say "get the elbow up". The elbow only needs to go high enough to get over and ahead of the shoulder on the throw. The smoothness and efficiency of this move is the key to consistent power and accuracy on a throw. With the loading of the suprasprinatus and subscapularis muscles in the "L" position the elbow can now elevate and move ahead of the shoulder aided by the deltoid to get to "Zero". "Zero" is orthopedic term given to the elbow in the lead position because the rotator cuff muscles are neutral with no strain on them. The "Zero" position places the elbow 6 inches ahead of the shoulder 45 degrees up and out and loads the tricep in a position to fire the ball down the target hallway.

Here, quarterback 10 has begun the forward motion of the football by leading with violent and forceful elbow action of the throwing arm. The football is now at its highest point in the delivery motion, and quarterback 10 has the nose of the ball pointed forward toward the intended target. As quarterback 10 continues the throwing motion from position 32, the arm action burst forward is led by the elbow.

Turning now to FIGS. 1D and 1E, representations of quarterback 10 in follow-through positions 42 and 46 are shown. Position 42 is the beginning of the follow-through stage, and position 46 is the end of the follow-through stage. The Maddox Article describes position 42 as follows:

> The kinetic chain of power that occurs as the tricep fires energy up through arm and out through the wrist/fingers into the ball. If the wrist fires early before the tricep the kinetic chain is out of order and the ball will sail or wobble. A quarterback that pulls down on the football does not extend and therefore is not getting the full benefit of the tricep. When trying to understand the power of extension on a throw, think of the difference between a pistol and a sniper rifle. Which one is more accurate and can shoot the bullet further? The sniper rifle. Why? It has a longer barrel that allows the force and spin to act longer on the bullet which in turn puts more accuracy and velocity in the bullet as it comes out of the barrel.

In position 42 depicted in FIG. 1D, a downward diagonal direction begins to bring the throwing arm across the sternum area of his chest. The arm maintains full extension at the elbow as the shoulders begin to rotate counter-clockwise for a right-handed thrower and clockwise for a left-handed thrower. This shoulder rotation shows the non-throwing shoulder now moving to the posterior of torso and the throwing shoulder moving to the anterior of the torso in a twisting action. In final position 46, the throwing hand of quarterback 10 will be at the opposite hip of his torso as shown in FIG. 1E. The correct final follow-through position is achieved with a lightning-quick throwing arm action that finishes with the throwing hand at the opposite hip or belt line of quarterback 10 (as illustrated by position 46 in FIG. 1E).

SUMMARY

Various embodiments of a training apparatus are disclosed. In one embodiment, the training apparatus includes a body section with at least one attachment portion for receiving a guide structure positioned to interfere with a throwing motion of a user that deviates from a proper throwing technique. When proper technique is used, the user may experience no interference between the guide structure and user's throwing hand or arm. In contrast, the user's hand, arm, or a held ball may contact portions of the training apparatus when the mechanics of the user's throwing motion deviate from the proper form, thereby providing immediate feedback.

This specification includes references to "one embodiment" or "an embodiment." The appearances of the phrases "in one embodiment" or "in an embodiment" do not necessarily refer to the same embodiment. Particular features, structures, or characteristics may be combined in any suitable manner consistent with this disclosure.

DETAILED DESCRIPTION OF EMBODIMENTS

Figure 1A:
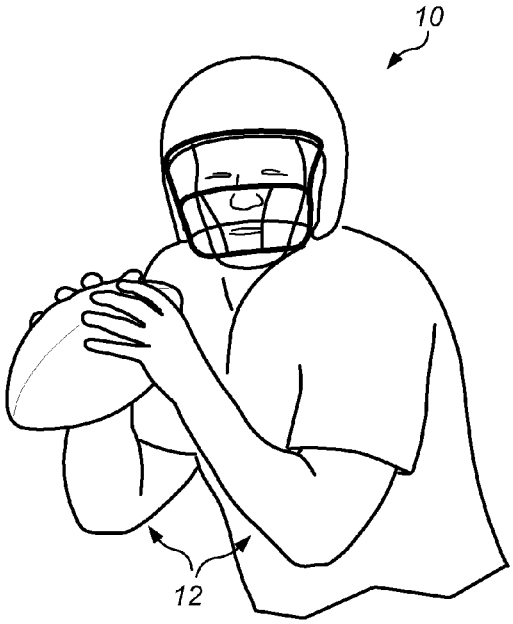
FIG. 1A (PRIOR ART)
FIGS. 1A-E depict various stages in a football throwing motion.
Figure 1B:
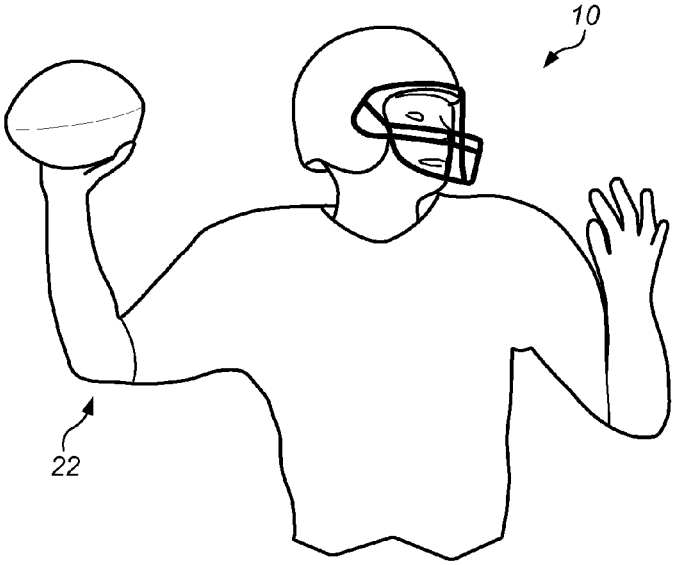
FIG. 1B (PRIOR ART)
Figure 1C:
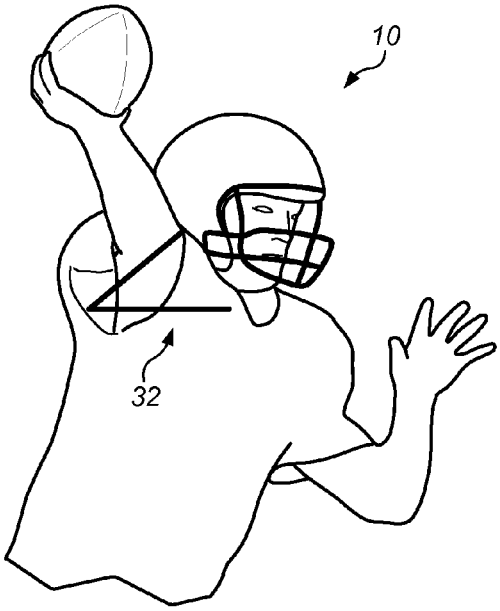
FIG. 1C (PRIOR ART)
Figure 1D:
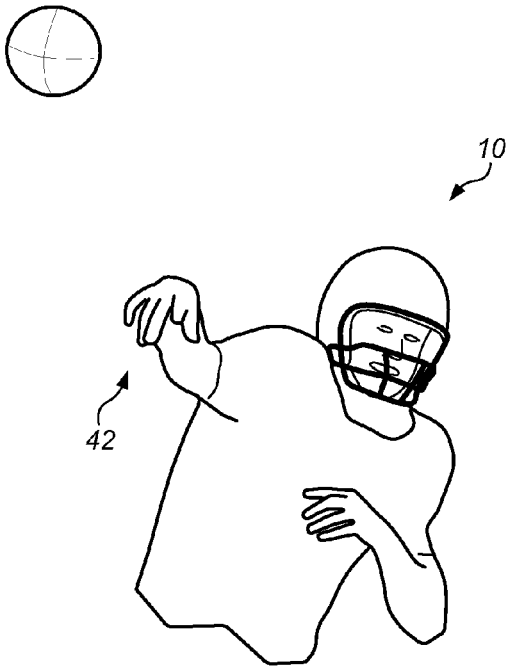
FIG. 1D (PRIOR ART)
Figure 1E:
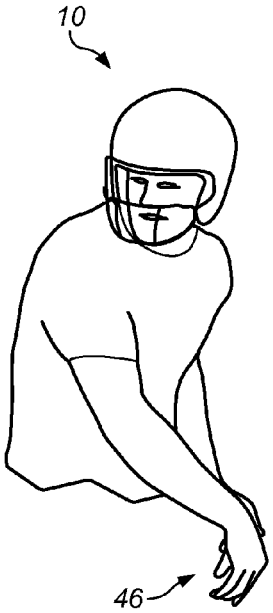
FIG. 1E (PRIOR ART)
Figure 2:
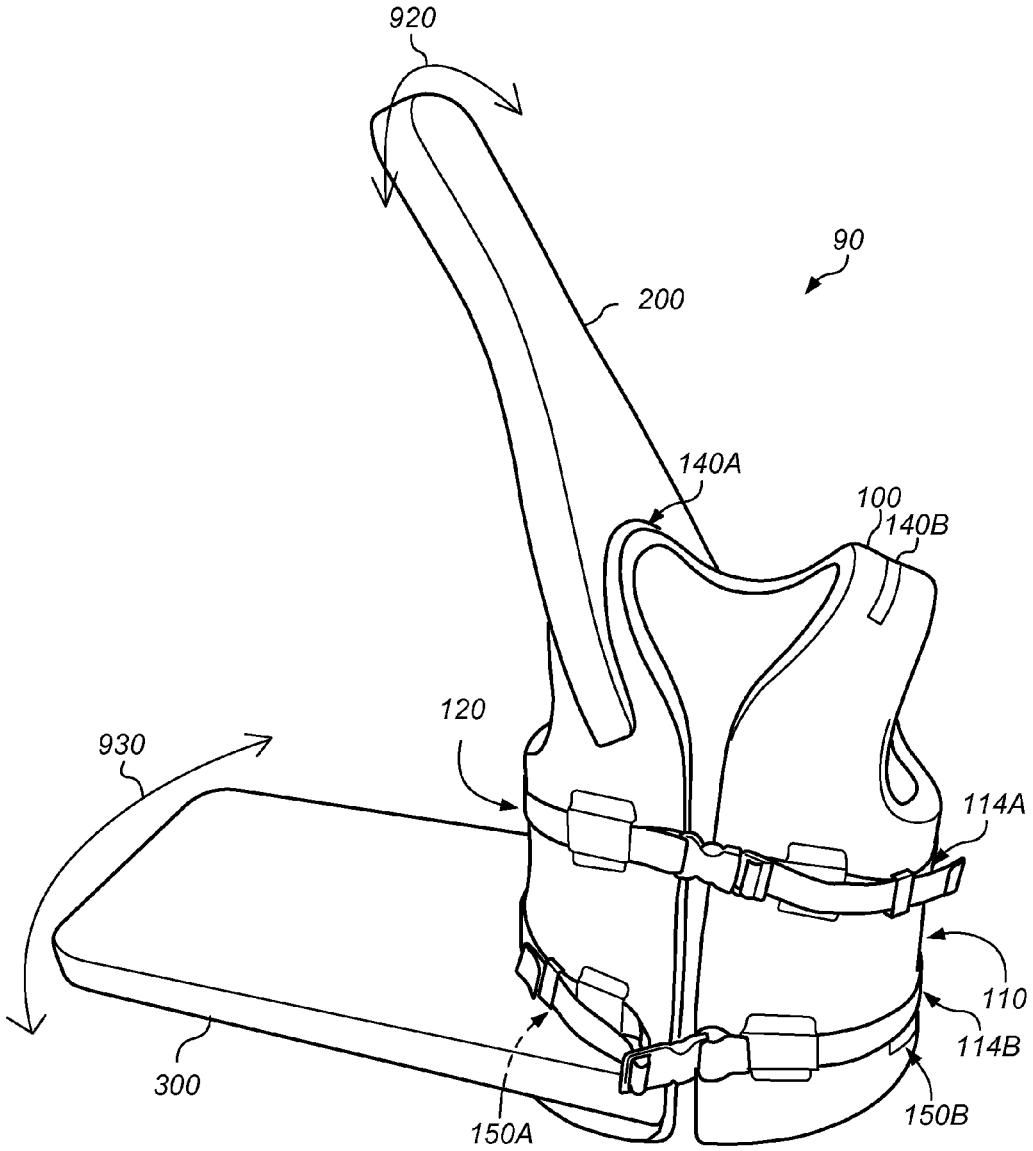
FIG. 2 depicts a view of one embodiment of a training apparatus.

Turning now to FIG. 2, a depiction of an exemplary training apparatus 90 is shown. Apparatus 90 includes a body section 100 that includes lateral portions 110 and 120 that, when worn by a user, respectively cover the left and right sides of the user's torso. Apparatus 90 further includes straps 114A and 114B for securing the body section to the user's torso. Still further, apparatus 90 includes upper guide structure 200 and lower guide structure 300. Upper guide structure 200, in the embodiment shown, is secured to the right shoulder portion of body section 100 by attachment portion 140A of body section 100 (that is, a portion of section 100 that permits the attachment of a guide structure such as element 200). In some embodiments, body section 100 may also include an attachment portion 140B on the left shoulder portion of body section 100. Attachment portions 140A and 140B may thus permit upper guide structure 200 to be removed from the right shoulder and reattached to the left shoulder. Similarly, lower guide structure 300, in the embodiment shown, is secured to the right hip portion of body section 100 by attachment portion 150A. In some embodiments, body section 100 may also include an attachment portion 150B. Attachment portions 150A and 150B may thus permit lower guide structure 300 to be removed from the right hip and reattached to the left hip. In this manner, apparatus 90 may, in some embodiments, be reconfigured for a left-handed user. In some embodiments, versions of apparatus 90 that are for a full-grown user weigh less than five pounds (in one embodiment body section 100 alone weighs less than three pounds); if apparatus is too heavy, it may unnecessarily interfere with the user's normal throwing motion. Of course, versions of apparatus 90 that are for smaller users will weigh correspondingly less.

In the embodiment shown in FIG. 2, body section 100 is designed such that, when worn by a user, it covers substantially all of a user's torso. As will be described below, body section 100 allows attachment of one or both of guide structures 200 and 300. The embodiment shown in FIG. 2 covers both a user's shoulders and hips; accordingly, this embodiment allows attachment of both upper guide structure 200 and lower guide structure 300.

Other embodiments may allow attachment of just a single guide structure. For example, in another embodiment (not shown), body section 100 may cover just the shoulder portions of the user, allowing the attachment of upper guide structure 200 but not lower guide structure 300. For example, in some embodiments, body section 100 may be fashioned in a manner that resembles standard football shoulder pads. In certain of these embodiments, apparatus 90 may be configured to permit upper guide structure 200 to be interchanged between the left and right shoulders of body section 100 (thus permitting the apparatus to be shared between both left- and right-handed users). In other embodiments, body section 100 may cover just one of the shoulders of the user—for example, one model of apparatus 90 may include a body section 100 that covers only the right shoulder of the user to receive upper guide structure 200. Such a model would be designed only for a right-handed user. A different model may be available for a left-handed user and cover only the left shoulder portion of the user's torso.

Similarly, in other embodiments (not shown), body section 100 may cover only a lower portion of the user's torso, and thus be designed to receive lower guide structure 300 but not upper guide structure 200. For example, in certain embodiments, body section may be configured as a belt-like structure worn around the user's waist. In certain of these embodiments, body section 100 may have attachment mechanisms 150A-B located on both hip portions. In other embodiments, body section 100 may include an attachment mechanism for only one hip portion, depending on whether apparatus 90 is designed for a left-handed or right-handed user.

In some embodiments, body section 100 may resemble a vest, as shown in FIG. 2. Body section may include structures such as straps 114A and 114B for providing a secure fit to the user's torso. In other embodiments, body section 100 may be secured to the user's torso with other suitable means, including, but not limited to, belts, hooks, VELCRO, etc. In other embodiments, body section 100 may be a harness, jacket, or a pull over-type configuration. In some embodiments, body section 100 may be constructed from a sturdy, breathable material to provide comfort while providing sufficient rigidity to provide support to the upper and lower guide structures 200 and 300. In various embodiments, body section 100 may be constructed as a single piece, as multiple pieces joined together, multiple pieces fastened together, multiple pieces coupled by means such as straps, belts, hook-and-loop fasteners, or other configurations or combinations. Body section 100 may in some cases facilitate adjustment to properly fit torsos of various sizes. Exemplary materials include foam (e.g., crosslink foam), canvas, neoprene, nylon, dipped vinyl, and various elastomeric polymers (e.g., EVA polymers). Features such as ventilation holes and breathable panels may be employed to increase comfort. Stiffening features, such as ribbing, may be included to improve rigidity. As noted above, some embodiments of the present training apparatus may include body section 100 and an upper guide structure 200, without including lower guide structure 300. Conversely, some embodiments of the present training apparatus may include body section 100 and lower guide structure 300, without including upper guide structure 200. The various embodiments of body section 100 described above and their structural equivalents are referred to as "body section means" in the appended claims.

As depicted, apparatus 90 includes upper guide structure 200 and lower guide structure 300. In various embodiments, structures 200 and 300 may be fin-shaped pieces. In some embodiments, one or both of the upper guide structure 200 and lower guide structure 300 may be fin-shaped pieces having rectangular outlines. Other embodiments may have upper guide structure 200 and lower guide structure 300 that are fin-shaped pieces having more circular outlines, or outlines of differing shapes. Other embodiments may include one or both of upper guide structure 200 and lower guide structure 300 that have a shape other than a fin shape, such as a thicker block, etc.

In various embodiments, upper guide structure 200 and lower guide structure 300 may be made from a variety of materials, including, but not limited to, foam (e.g., crosslink foam), dipped vinyl, neoprene, elastomeric materials, etc. In many embodiments, structures 200 and 300 include a material that is sufficiently rigid to interfere with an improperly executed throwing motion, but not so rigid that a user's arm or hand is injured by contacting these structures upon an improperly executed throw. Note that structures 200 and 300 may not be made from just a single material. For example, in one embodiment, either or both of structures 200 and 300 may include reinforcing materials, materials used to provide an attachment between guide structure 200 or 300 and body section 100 (e.g., an EVA polymer structure in one embodiment), etc. Also, in some embodiments, either or both of structures 200 and 300 may include a protective covering that includes a substance (e.g., a hydrogel) that is used to soften or cushion the user's arm/hand against potential injury. This arrangement may be useful when the core of structures 200 and/or 300 is made of a rigid material.

In different embodiments of apparatus 90, the dimensions of upper and lower guide structures 200 and 300 may vary according to the size of the torso and arm length of the wearer. In some embodiments of a larger-size version of apparatus 90, the dimensions of each of upper guide structure 200 and lower guide structure 300 may range from 8-14 inches in width, 8-18 inches in length (i.e., from the tip of the structure to the bottom portion where it attaches to body section 100), and ¾ inch to 4 inches thick. Conversely, in some embodiments of a smaller-size version of apparatus 90 (e.g., for a youth), the dimensions of each of upper guide structure 200 and lower guide structure 300 can range from 7-12 inches in width, 7-15 inches in length, and ¾ inch to 4 inches thick. Thus, in various embodiments, structures 200 and 300 are both at least 7 inches long, 7 inches wide, and ¾ inch thick, and are both no more than 18 inches long, 14 inches wide, and 4 inches thick. In other embodiments, upper guide structure 200 is at least 7 inches long, 7 inches wide, and ¾ inches thick. In still other embodiments, lower guide structure 300 is at least 7 inches long, 7 inches wide, and ¾ inches thick. As stated, however, the dimensions of apparatus 90 can vary according to the dimensions of an individual user.

Figure 4:
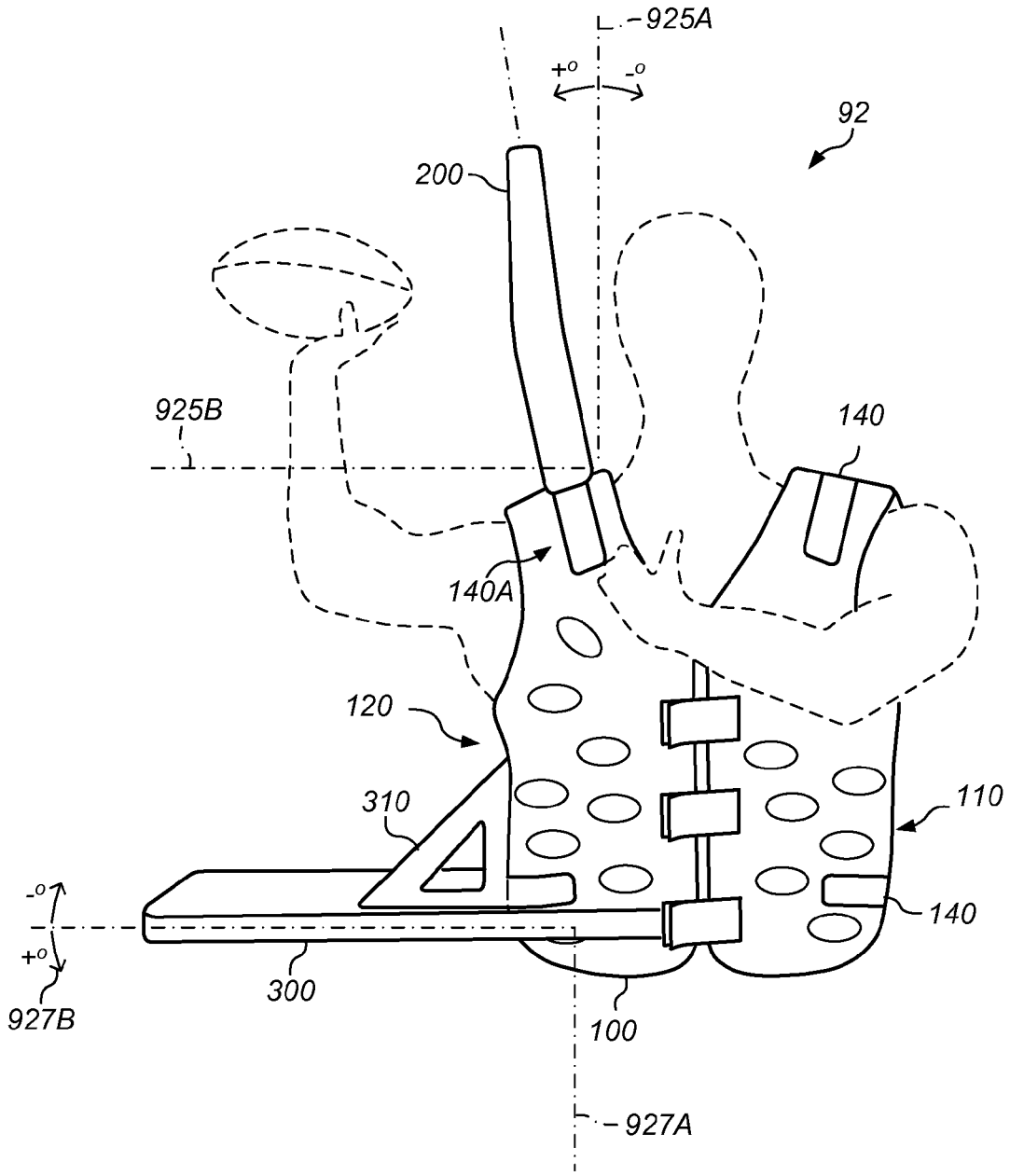
FIG. 4 depicts a front view of an embodiment of a training apparatus being worn by a user.

As shown in FIG. 2, upper guide structure 200 extends from a shoulder portion of body section 100. (Typically, structure 200 will extend from the shoulder portion that corresponds to the user's throwing arm.) In various embodiments, structure 200 extends upward from a shoulder portion of body section 100. As used herein, the phrase "extends upward" refers to a range of positions. Consider a first imaginary line extending upward from the user's throwing shoulder (see reference numeral 925A in FIG. 4). Next consider a second imaginary line extending outward, parallel to the ground from the same shoulder (see reference numeral 925B in FIG. 4). The second line is separated from the first line by 90 degrees. Next consider a nomenclature such that a positive angle between 0 and 90 degrees refers to an angular position from the first imaginary line (925A) away from the user's head toward the throwing shoulder (a positive 90 angle would mean that structure 200 would be extending parallel to line 925B). Conversely, a negative angle between 0 and 90 degrees refers to an angular position from the first imaginary beginning toward the user's head and toward the non-throwing shoulder. FIG. 4 illustrates this convention, showing a positive angle is from line 925A away from the user's head and that a negative angle is from line 925A toward the user's head. Accordingly, when the present disclosure and claims refer to upper guide structure 200 "extending upward" from a shoulder portion of body section 100, this means that upper guide structure 200 is between −5 degrees and 30 degrees from the first imaginary line. This convention (and thus the definition of "extending upward") applies even if upper guide structure 200 is positioned on the left side of the user's body—a negative angle is away from the user's throwing shoulder and a positive angle is toward the user's throwing shoulder.

In other embodiments, depending on a particular user's configuration, upper guide structure 200 may be positioned differently relative to a shoulder portion of body section 100. As will be described further below, upper guide structure 200 is typically positioned such that it interferes with an improper throwing motion by a user, but does not impede a user that exhibits a proper throwing motion.

As shown in FIG. 2, lower guide structure 300 extends from a hip portion of body section 100. (Typically, structure 300 will extend from the hip portion that corresponds to the user's throwing arm.) In various embodiments, structure 300 extends sideways from a hip portion of body section 100. As used herein, the phrase "extends sideways" refers to a range of positions. Consider a first imaginary line extending up from the ground through the user's hip (see reference numeral 927A in FIG. 4). Next consider a second imaginary line that that extends outward from the same hip (see reference numeral 927B in FIG. 4). The second line is separated from the first line by 90 degrees. Next consider a nomenclature such that a positive angle between 0 and 90 degrees refers to an angular position from the second imaginary line (927B) toward that portion of the first imaginary line that corresponds to the user's lower body (927A). Conversely, a negative angle refers to an angular position from the second imaginary line toward that portion of the first imaginary line that corresponds to the user's upper body. FIG. 4 illustrates that a positive angle from line 927B is toward the lower part of the user's body, while a negative angle is toward the upper part of the user's body. Accordingly, when the present disclosure and claims refer to lower guide structure 300 "extending sideways" from a hip portion of body section 100, this means that lower guide structure 300 is between −30 degrees and 30 degrees from the first imaginary line. This convention (and thus the definition of "extending sideways") applies even if lower guide structure 300 is positioned on the left side of the user's body—a negative angle is toward the upper half of the user's body and a positive angle is toward the lower half of the user's body.

In other embodiments, depending on a particular user's configuration, lower guide structure 300 may be positioned differently relative to a hip portion of body section 100. As will be described further below, lower guide structure 300 is typically positioned such that it interferes with an improper throwing motion by a user, but does not impede a user that exhibits a proper throwing motion.

Figure 3:
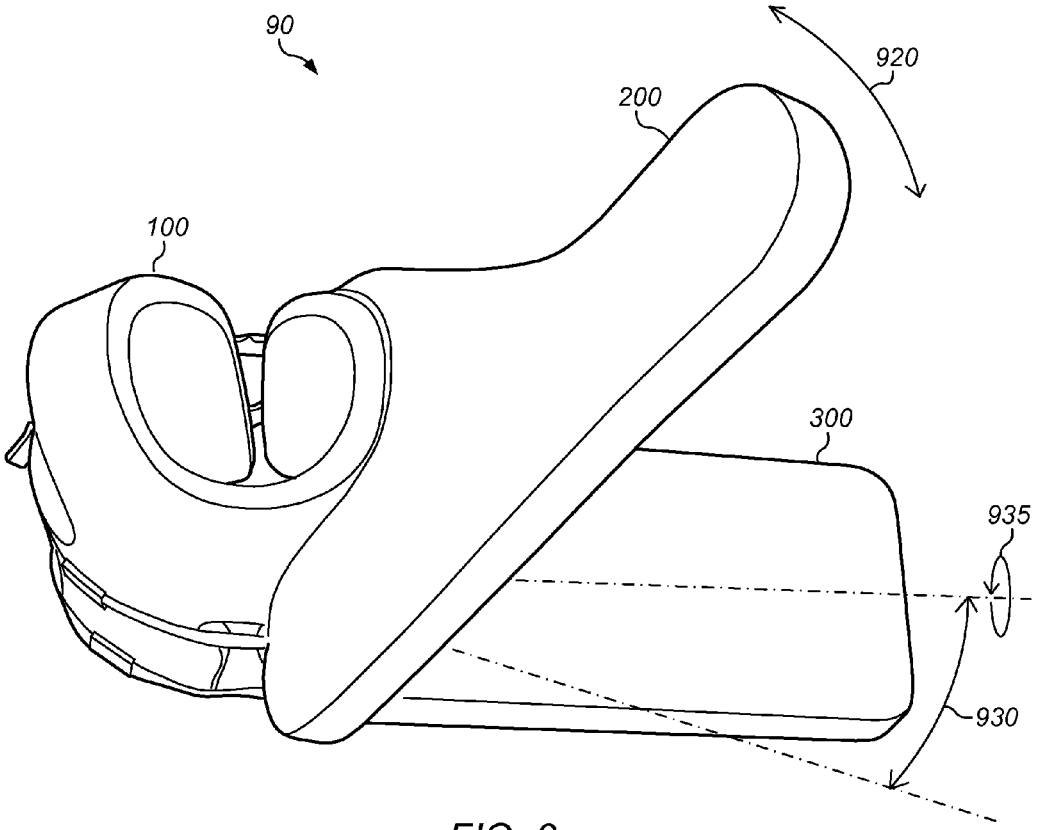
FIG. 3 is a view of one embodiment of a training apparatus, as viewed from above and behind.

As described in the preceding paragraphs, guide structures 200 and 300 may be configured in a range of positions relative to body section 100 (and more particularly, to imaginary lines extending from the ground through the user's hip and shoulder regions). Some embodiments may also allow adjustability of the orientation of upper guide structure 200 and/or lower guide structure 300 in other manners. This adjustability may allow apparatus 90 to more particularly address a user's physical build and/or needed area of training or correction. For example, reference numeral 920 in FIGS. 2 and 3 shows that the forward-to-rear position of upper guide structure 200 may be adjusted. Reference numeral 930 in FIGS. 2 and 3 also depicts that the forward-to-rear position of lower guide structure 300 may also be adjusted as needed.

FIG. 4 also shows that the forward-rear tilt of lower guide structure 300 may allow variation in angle 935 to be customized to a particular user's needs. In some embodiments, the forward-rear tilt may be adjusted plus or minus 45 degrees (angle 935 having a range of 45 degrees forward to 45 degrees rear). Other embodiments may allow more or less adjustment. In some embodiments, the allowable adjustment may not be symmetric (e.g., angle 935 having a range of 45 degrees forward to 15 degrees rear). Some embodiments may allow adjustment in only one direction (e.g., angle 935 having a range of 30 degrees forward to zero degrees rear).

The various embodiments of upper guide structure 200 described above and their structural equivalents are referred to in the appended claims as "upper guide means." Similarly, the various embodiments of lower guide structure 300 described above and their structural equivalents are referred to in the appended claims as "lower guide means." Collectively, the "upper guide means" and the "lower guide means" are referred to as the "guide means" in the appended claims.

In various embodiments, such as that shown in FIG. 2, body section 100 includes attachment portions 140A and 140B and attachment portions 150A and 150B. Attachment portions 140 and 150 may constitute any suitable means for receiving guide structures 200 and 300 including, but not limited to, braces, clamps, hook-and-loop fasteners, snaps, hooks, buckles, straps, quick-release fasteners (e.g., quarter-turn fasteners), zippers, etc. The various embodiments of attachment portions 140 and 150 described above and their structural equivalents are referred to in the appended claims as "attachment means."

In some embodiments, a particular apparatus 90 may be configured such that either or both of guide structures 200 and 300 are permanently attached to body section 100. The phrase "permanently attached" does not connote that a structure may not be removed from body section 100, only that apparatus 90 is not designed to permit a user to detach a guide structure. In other words, such guide structures are not meant to be removed from body section 100, but rather are intended to remain affixed throughout the life of apparatus 90. Thus, in some embodiments, guide structures 200 and 300 may be affixed to body section 100 via attachment mechanisms 140 and 150, which, in one embodiment, may constitute braces or brackets with no release mechanism. FIG. 4 illustrates one embodiment of a brace 310 used to keep lower guide structure 300 in place. In certain embodiments, a particular apparatus 90 might therefore be designed exclusively for either a left-handed or right-handed user, without any ability to reconfigure the apparatus.

In other configurations, guide structures 200 and 300 may be removable attached to body section 100. The phrase "removable attached" connotes that these structures are designed to be removed and reattached by the user. For example, guide structures 200 and 300 may be attached to attachment portions 140 and 150 via a structure that has a release mechanism, such as a latch or clamp or brace (such as brace 310 shown in FIG. 4). In various embodiments, the release mechanism may be located fully on the guide structure, fully on the attachment portion, or a combination of both. In certain embodiments, body section 100 may include attachment portions for only one side of the user's body. In such embodiments, apparatus 90 is designed exclusively for either a left-handed or a right-handed user.

In still other embodiments, upper guide structure 200 and lower guide structure 300 may be removable attached to body section 100, and may be reattached to the opposite side of the body section to facilitate use by either right-handed or left-handed users. For example, the embodiments depicted in FIGS. 2, 4, and 6 have upper guide structure 200 and lower guide structure 300 attached to the right-side portion 120 of body section 100, providing a configuration that is suitable for a right-handed user. In these figures, attachment structures 140B and 150B also exist on the left side portion 110 of body section 100, thereby allowing for reconfiguration of the depicted embodiments. As noted above, such removable attachment may be achieved in particular implementations using various techniques, such as braces, clamps, hook-and-loop fasteners, snaps, hooks, buckles, straps, quick-release fasteners (e.g., quarter-turn fasteners), zippers, etc.

Figure 5A:
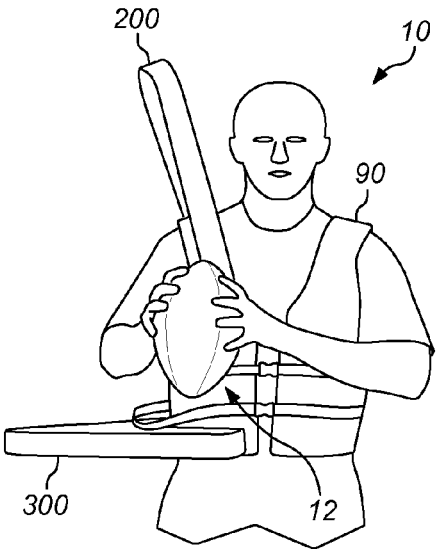
FIGS. 5A-E depict various stages of a proper football throwing motion when wearing an embodiment of a training apparatus.
Figure 5B:
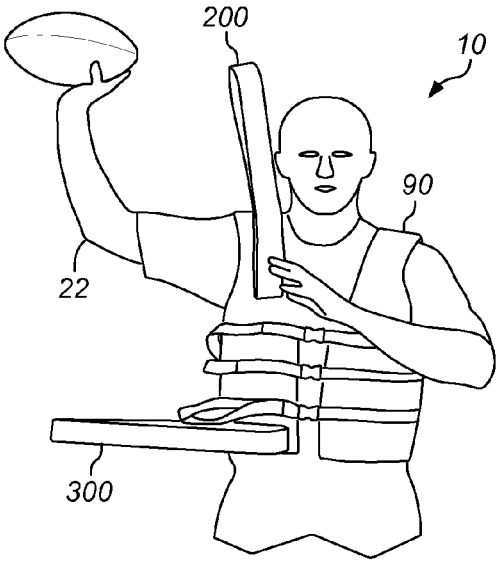
Figure 5C:
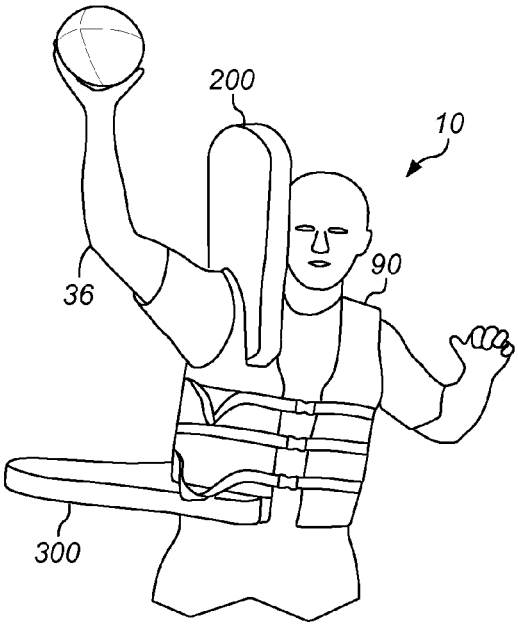
Figure 5D:
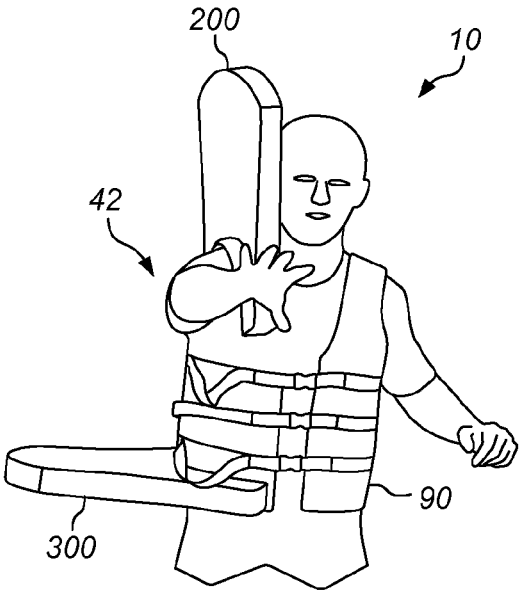
Figure 5E:
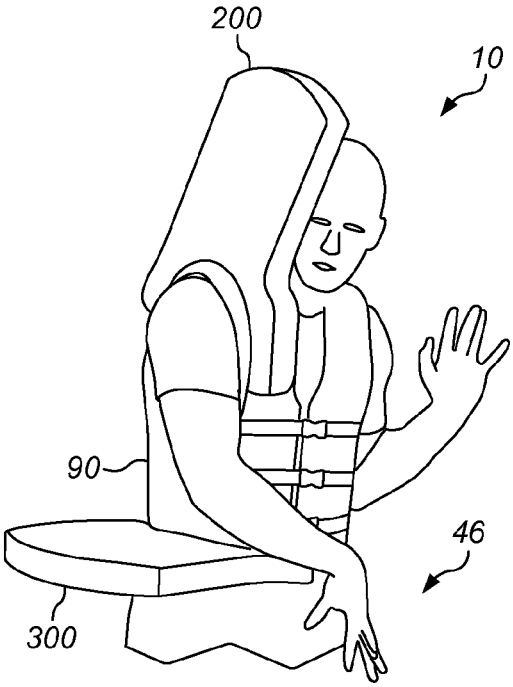

Turning now to FIGS. 5A-E, depictions of various stages of a proper football throwing motion are shown with a user 10 wearing an embodiment of apparatus 90 that includes both upper and lower guide structures 200 and 300. FIG. 5A depicts a user with the football held in the pre-pass triangle position 12. In FIG. 5B, user 10 has raised the football to L position 22. In FIG. 5C, user 10 has extended the throwing arm through position 32 to position 36 (and subsequently to follow-through positions 42 and 46, shown in FIGS. 5D and 5E, respectively). Notably, guide structures 200 and 300 are positioned relative to body section 100 such that they will not interfere with the throwing motion of a user that follows the throwing motion depicted in FIGS. 5A-E—that is, structures 200 and 300 will not contact the user's throwing arm and thus provide tactile feedback, engaging the kinetic learning behavior of user regarding a correct throwing motion (as opposed to an incorrect throwing motion). By not contacting the upper guide structure 200 or the lower guide structure 300, the user learns through kinesthetic movements what to do in a proper throwing motion. Kinetic learning takes place with repeated kinesthetic movements. Embodiments of apparatus 90 facilitates kinetic learning by providing the user with the freedom of muscle movements and voluntary muscle recruitment needed for correct muscle memory development and long-term learned muscle memory skills.

Figure 5F:
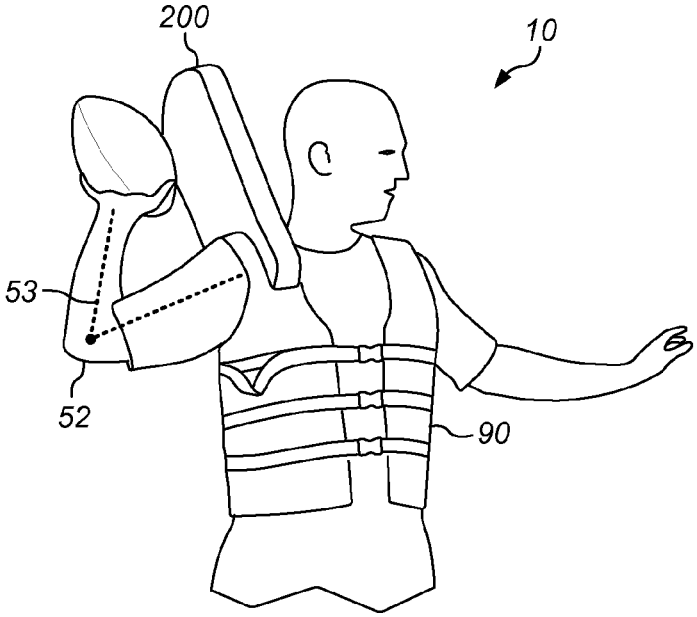
FIGS. 5F and 5G depict incorrect football throwing motions when wearing an embodiment of a training apparatus.

On the other hand, one or both of structures 200 and 300 may be positioned to interfere with an incorrect throwing motion of a user. For example, in FIG. 5F, an embodiment of apparatus 90 is shown with upper guide structure 200, but no lower guide structure 300. As shown in FIG. 5F, upper guide structure 200 is positioned such that if user 10 "winds up" by wrapping the ball and throwing hand behind the head (as is depicted in FIG. 5F), upper guide structure 200 will be contacted by the ball and/or the throwing hand, thereby providing immediate tactile feedback as to the user's incorrect mechanics. Another way of describing the improper throwing motion shown in FIG. 5F is that the user's throwing arm forms an acute angle (i.e., an angle of less than 90 degrees), as illustrated by angle 53 shown in FIG. 5F. (By way of contrast, in a proper throwing motion, the user's throwing arm forms an angle of greater than or equal to 90 degrees in the L position—one example of this is shown in FIG. 5B.) As used herein, the notion of an angle of the user's throwing arm is measured by an imaginary line from the user's shoulder to the user's elbow, and from the user's elbow to the user's wrist. If the user's lower arm is orthogonal to the user's upper arm, the throwing arm is said to be at a 90 degree angle for purposes of this disclosure. As the user's lower arm moves toward the user's head, the angle becomes acute. In some configurations, upper guide structure 200 is arranged to provide interference to the user's throwing motion when the user's throwing arm forms any angle of less than 90 degrees. Such an arrangement is in keeping with proper throwing mechanics, which begin to break down when a user's throwing arm forms an acute angle while bringing the ball backwards from the pre-pass triangle position. In other configurations, upper guide structure 200 may be arranged to provide interference to the user's throwing motion when the user's throwing arm forms an angle of a smaller number of degrees—for example, in some embodiments, upper guide structure 200 may begin to interfere with the user's throwing motion when the user's throwing arm forms an angle of 85 degrees or less, 80 degrees or less, 75 degrees or less, 70 degrees or less, etc. (Accordingly, an apparatus with an upper guide structure that only begins to interfere with the user's throwing motion when the user's throwing arm is at, e.g., an 88 degree angle is therefore contemplated by the present disclosure.) In general, by contacting upper guide structure 200 the user is able to learn through kinesthetic movements physical movements that should be avoided in attempting to achieve a proper throwing motion.

Figure 5G:
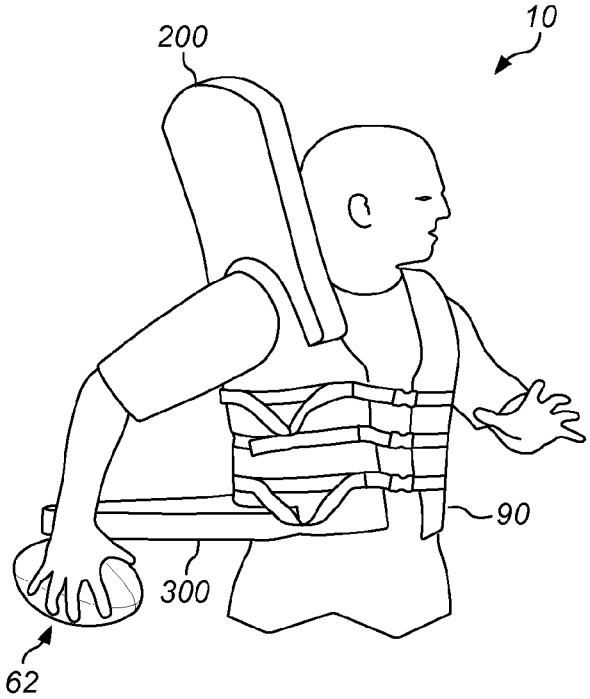

Similarly, FIG. 5G depicts an illustration of lower guide structure 300 interfering with the throwing motion of user 10 when the user drops his hand prior to, or while initiating (e.g., while "winding up") a throwing motion. Lower guide structure 300 may also be contacted if the user follows through incorrectly and brings the right-side throwing arm to the right side hip (instead of to the left-side hip) after releasing the football. By contacting lower guide structure 300, the user learns through kinesthetic movements "what not to do" in a proper throwing motion. Thus, embodiments of the present apparatus may provide a user with tactile feedback in cases where improper technique is performed, while leaving the throwing motion unconstrained in cases where proper technique is performed. In contrast, conventional training apparatus that may use guides (e.g., tracks, rails, elastic tubing, tension cords) to force a user's motion to follow an involuntary trajectory do not leave the user's throwing motion unconstrained when proper technique is performed.

Figure 6:
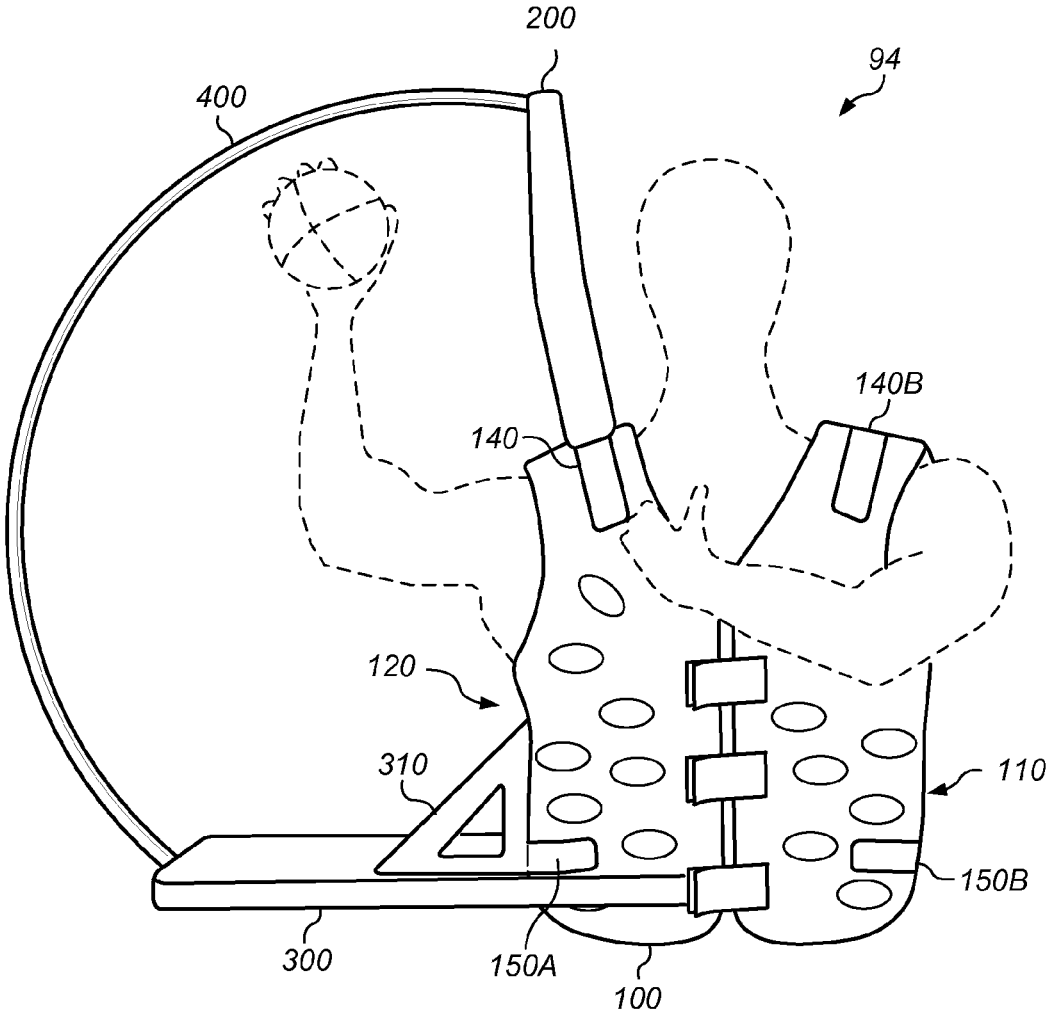
FIG. 6 depicts a front view of another embodiment of a training apparatus being worn by a user.

Turning now to FIG. 6, one embodiment of a training apparatus 94 is shown. Apparatus is similar to apparatuses 90 and 92 described above, but includes an additional structure 400 for providing feedback. For example, attachment 400 may be used to provide further tactile feedback in cases where desired technique is violated (e.g., too much extension of the arm at the beginning of the throwing motion). Attachment 400 may also (or alternately) provide structural rigidity to the training apparatus. Attachment 400 may provide visual feedback as an additional training tool to measure the height or location of ball on release or the angle and level of football upon release. Other structures may be implemented to customize the training apparatus to particular user needs.

Although several of the figures described above are presented in the context of training a user in the proper techniques for throwing a football, the present techniques and structures are also well suited for training other similar throwing motions, including, but not limited to, baseball. These techniques may be applicable, for example, to pitching a baseball from the "stretch" position, or to certain throws made by an infielder (e.g., in turning a double-play). The application of the various embodiments of the apparatus 90 described herein is in no way limited to football.

Although specific embodiments have been described above, these embodiments are not intended to limit the scope of the present disclosure, even where only a single embodiment is described with respect to a particular feature. Examples of features provided in the disclosure are intended to be illustrative rather than restrictive unless stated otherwise. The above description is intended to cover such alternatives, modifications, and equivalents as would be apparent to a person skilled in the art having the benefit of this disclosure.

The scope of the present disclosure includes any feature or combination of features disclosed herein (either explicitly or implicitly), or any generalization thereof, whether or not it mitigates any or all of the problems addressed herein. Accordingly, new claims may be formulated during prosecution of this application (or an application claiming priority thereto) to any such combination of features. In particular, with reference to the appended claims, features from dependent claims may be combined with those of the independent claims and features from respective independent claims may be combined in any appropriate manner and not merely in the specific combinations enumerated in the appended claims.

What is claimed is:

1. An apparatus for training a user to throw a ball, the apparatus comprising:

a body section configured to be worn over at least a portion of the user's torso;

an upper guide structure having a length in a range of 7 to 18 inches and attached to the body section such that the upper guide structure extends upwardly from a shoulder portion thereof on a side of the body section that corresponds to the user's throwing hand, wherein the upper guide structure is positioned to interfere with the user's throwing motion when the user brings the ball behind the user's head, and wherein the upper guide structure is positioned to not interfere with the user's throwing motion when the user brings the ball forward from an L position; and a lower guide structure having a length in the range of 7 to 18 inches and attached to the body section such that the lower guide structure extends sideways from a hip portion on the side of the body section that corresponds to the user's throwing hand, wherein the lower guide structure is positioned to interfere with the user's throwing motion when the user drops the ball below the user's hip during windup, and wherein the lower guide structure is positioned to not interfere with the user's throwing motion when the user brings the ball upward from a pre-pass triangle position to the L position.

2. The apparatus of claim 1, wherein at least one of the upper guide structure and the lower guide structure is removably attached to the body section.

3. The apparatus of claim 1, wherein the upper guide structure has a width in a range of 7 to 14 inches and a thickness in a range of ¾ inch to 4 inches.

4. The apparatus of claim 1, wherein at least one of the upper guide structure and the lower guide structure is permanently attached to the body section.

5. The apparatus of claim 1, wherein the upper guide structure and the lower guide structure are made of a foam material.

6. The apparatus of claim 1, wherein the apparatus weighs no more than five pounds.

7. The apparatus of claim 6, wherein the upper guide structure and the lower guide structure are of sufficient rigidity to interfere with an incorrect throwing motion by the user, but include a material that will not cause the user to be injured when interference is provided during the incorrect throwing motion.

8. The apparatus of claim 7, wherein the material is selected from the group consisting of: foam, neoprene, dipped vinyl, hydrogels, and elastomeric material.

9. The apparatus of claim 1, wherein the upper guide structure is positioned to interfere with the user's throwing motion when the user's throwing arm forms an angle of less than 90 degrees in bringing the ball backward from the pre-pass triangle position.

10. The apparatus of claim 1, wherein the body section includes first and second attachment mechanisms positioned on respective shoulder portions of the body section, wherein the first and second attachment mechanisms are both configured to receive the upper guide structure, and wherein the first and second attachment mechanisms are releasable to permit removal of the upper guide structure.

11. The apparatus of claim 1, wherein the body section includes first and second attachment mechanisms positioned on respective shoulder portions of the body section, wherein the first and second attachment mechanisms are both configured to receive the upper guide structure, and wherein the first and second attachment mechanisms are releasable to permit removal of the upper guide structure;

wherein the body section further includes third and fourth attachment mechanisms positioned on respective hip portions of the body section, wherein the third and fourth attachment mechanisms are both configured to receive the lower guide structure, and wherein the third and fourth attachment mechanisms are releasable to permit removal of the lower guide structure.

12. An apparatus for training a user to throw a ball, the apparatus comprising:

a body section configured to be worn over at least a portion of the user's torso;

an upper guide structure attached to the body section such that the upper guide structure extends upwardly from a shoulder portion thereof on a side of the body section that corresponds to the user's throwing hand, wherein the upper guide structure is positioned to interfere with the user's throwing motion when the user brings the ball behind the user's head, and wherein the upper guide structure is positioned to not interfere with the user's throwing motion when the user brings the ball forward from an L position; and a lower guide structure attached to the body section and extending from a hip portion on the side of the body section that corresponds to the user's throwing hand, wherein the lower guide structure is positioned to interfere with the user's throwing motion when the user drops the ball below the user's hip during windup, and wherein the lower guide structure is positioned to not interfere with the user's throwing motion when the user brings the ball upward from a pre-pass triangle position to the L position.

13. The apparatus of claim 12, wherein the lower guide structure has dimensions in a range of 7 to 18 inches long, 7 to 14 inches wide, and ¾ inch to 4 inches thick.

14. The apparatus of claim 12, wherein the lower guide structure extends sideways from the hip portion of the body section.

15. The apparatus of claim 12, wherein the body section includes first and second attachment mechanisms positioned on respective hip portions of the body section, wherein the first and second attachment mechanisms are both configured to receive the lower guide structure, and wherein the first and second attachment mechanisms are releasable to permit removal of the lower guide structure.

16. An apparatus for training a user to throw a ball, the apparatus comprising:

means for being worn on the user's torso, wherein the means for being worn includes a hip portion and a shoulder portion;

first and second means for interfering with an incorrect ball throwing motion by the user; and means for receiving the first and second means for interfering, wherein the means for receiving is coupled to the hip and shoulder portions of the means for being worn;

wherein the first and second means for interfering are coupled to the means for receiving.

17. The apparatus of claim 16, wherein:

the first means for interfering is configured to interfere with the user's throwing motion when the user brings the ball forward from a position behind the user's head; and the second means for interfering is configured to interfere with the user's throwing motion when the user drops the ball below the user's hip during windup.

18. The apparatus of claim 17, wherein the first means for interfering and the second means for interfering are both at least 7 inches long, 7 inches wide, and ¾ inch thick, and no more than 18 inches long, 14 inches wide, and 4 inches thick.

19. The apparatus of claim 18, wherein the apparatus weighs less than five pounds.

20. The apparatus of claim 19, wherein the first means for interfering extends upward from a shoulder portion of the means for being worn, and wherein the second means for interfering extends sideways from a hip portion of the means for being worn.

* * * * *